United States Patent [19]

Kone

[11] 4,130,370

[45] Dec. 19, 1978

[54] LIGHT-REFLECTIVE ROAD MARKER OF SELF-CLEANING TYPE

[75] Inventor: Elliott H. Kone, Branford, Conn.

[73] Assignee: Traffic Standard Incorporated, Branford, Conn.

[21] Appl. No.: 850,913

[22] Filed: Nov. 14, 1977

[51] Int. Cl.[2] ..... E01F 9/00

[52] U.S. Cl. ..... 404/11

[58] Field of Search ..... 404/11, 10, 9, 17

[56] References Cited

U.S. PATENT DOCUMENTS

| | | | |
|---|---|---|---|
| 3,373,667 | 3/1968 | Meyers | 404/17 X |
| 3,717,076 | 2/1973 | Shields | 404/11 |
| 3,850,536 | 11/1974 | Kone | 404/11 |

FOREIGN PATENT DOCUMENTS

| | | | |
|---|---|---|---|
| 614657 | 1948 | United Kingdom | 404/11 |

*Primary Examiner*—Nile C. Byers, Jr.
*Attorney, Agent, or Firm*—Walter Spruegel

[57] ABSTRACT

Road marker in a road bed having at the road level a resilient diaphragm carrying a light-reflective lens yieldingly projecting above the road level and operationally depressible below the road level by an automotive wheel passing over the lens, with the diaphragm providing opposite wiper blades extending at the road level into contact with opposite faces of the lens and cleaning these faces on operational depression of the lens below, and its recovery into projection above, the road level.

3 Claims, 5 Drawing Figures

LIGHT-REFLECTIVE ROAD MARKER OF SELF-CLEANING TYPE

Figure 1:
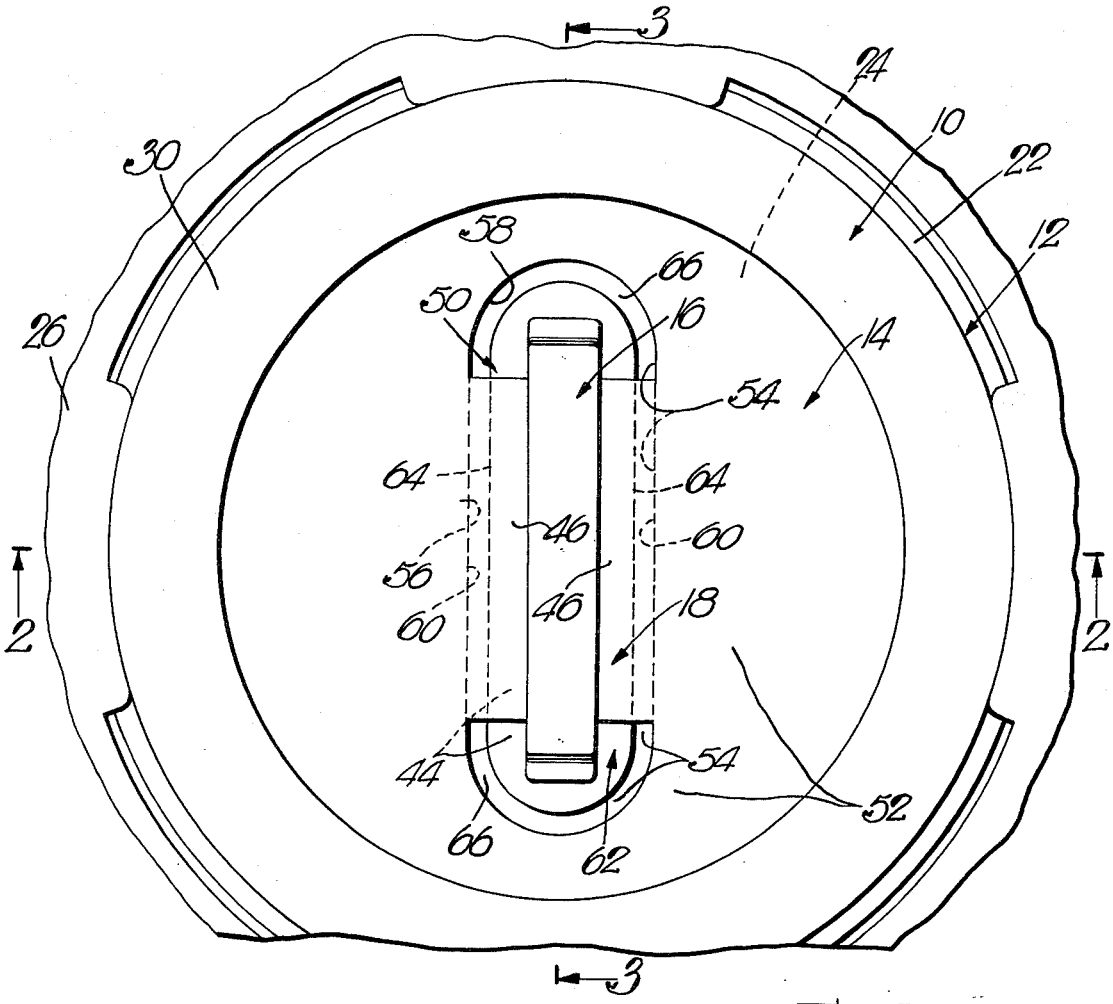

This invention relates to light-reflective road markers in general, and to light-reflective road markers of self cleaning type in particular.

The invention is concerned with a road marker of which the light-reflective lens is mounted on a resilient diaphragm at the top of a cup-like casing which is embedded in a finished road bed, with the lens normally projecting above the road bed for reflecting the light from oncoming automotive vehicles back to the drivers of the vehicles and thereby serve as a light beacon for guiding the vehicles within the marked lane. The diaphragm of the marker is resilient to permit the lens to yield safely into the interior of the casing if a wheel of an automotive vehicle passes over the marker by accidental or deliberate action of the driver, with the diaphragm on its recovery returning the lens to its normal light-reflective disposition for continued service. While such markers are satisfactory in most respects, they are deficient in one important respect. Thus, these markers are subjected to all kinds of dirt and weather which in no time at all brings about tarnishing of their lenses to the point where they fail to reflect light and, hence, would be useless unless kept clean by frequent personal cleaning by maintenance crews at no less than prohibitive cost.

It is among the objects of the present invention to provide a road marker of this type with a cleaning system which responds to the yield of the lens into the interior of the marker casing under a passing wheel to clean the lens of any dirt that might interfere with its light-reflective performance. With this arrangement, the cleaning of the lens of any installed marker in a road may well be attended to automatically and by private vehicles which in the course of their travel on the marked road pass with a wheel over the marker either accidentally or deliberately, which on the average will occur most likely at sufficiently frequent intervals to keep the lens clean. However, if sole reliance on private vehicles for cleaning the lenses of any number, large or small, of markers on a road should be frowned upon, it is entirely feasible to despatch a vehicle of the Highway Department, for example, and drive it over the markers on the road for cleaning the lenses at a cost which is sufficiently low to be fully justified, especially since only a single fast pass over the markers will clean the lenses.

It is another object of the present invention to provide a road marker of this type of which the aforementioned cleaning system provides a pair of wiper blades which are formed on the diaphragm and normally extend with their wiping edges into contact with the bottoms of opposite light-reflective faces of the lens in its normal rest position, and a lens mount on the diaphragm which on the passage of a wheel over the lens permits safe depression of the latter into the interior of the marker casing and past the wiper blades, with the lens mount being sufficiently resilient in its action to yield to the lens under its operational depression under a passing wheel and, on passage of the wheel, recover to its rest position with a lively snap action which is highly conducive to a powerful wiping action by the blades on the light-reflective lens faces.

Further objects and advantages will appear to those skilled in the art from the following, considered in conjunction with the accompanying drawings.

Figure 2:
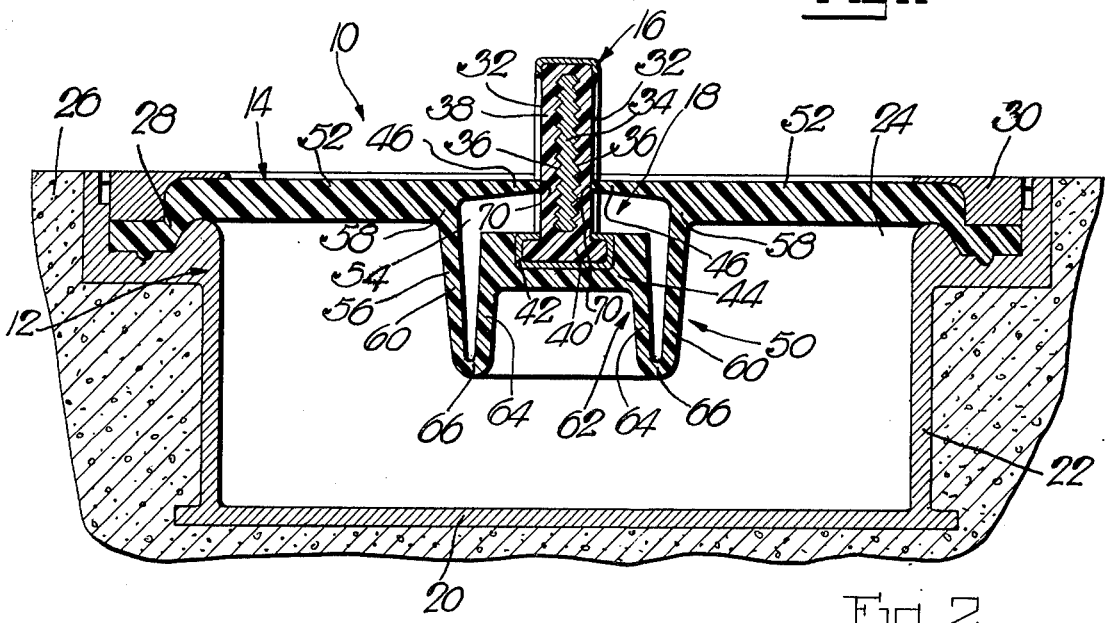
Figure 3:
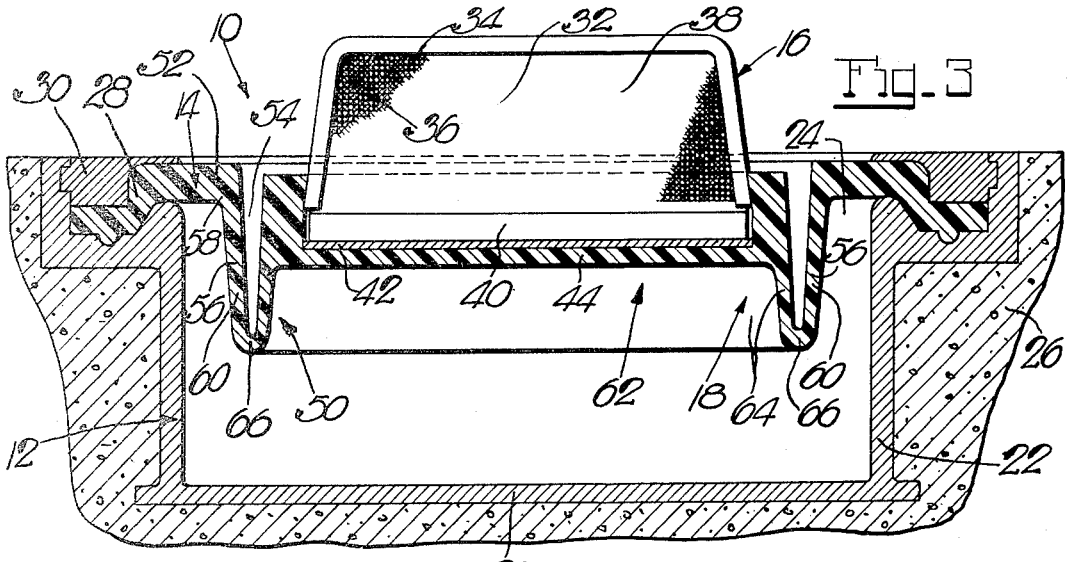
Figure 4:
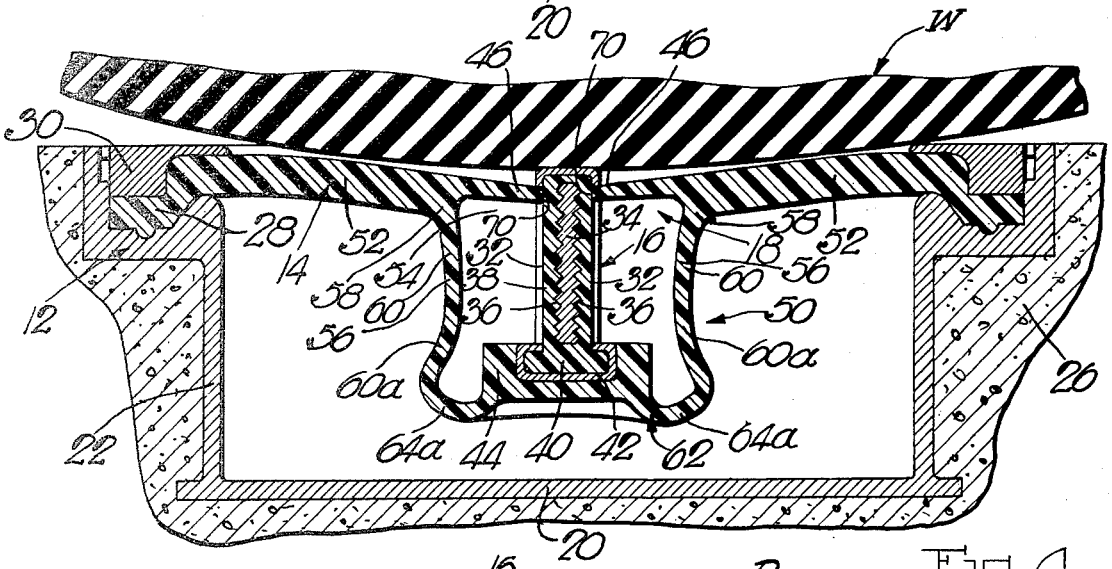
Figure 5:
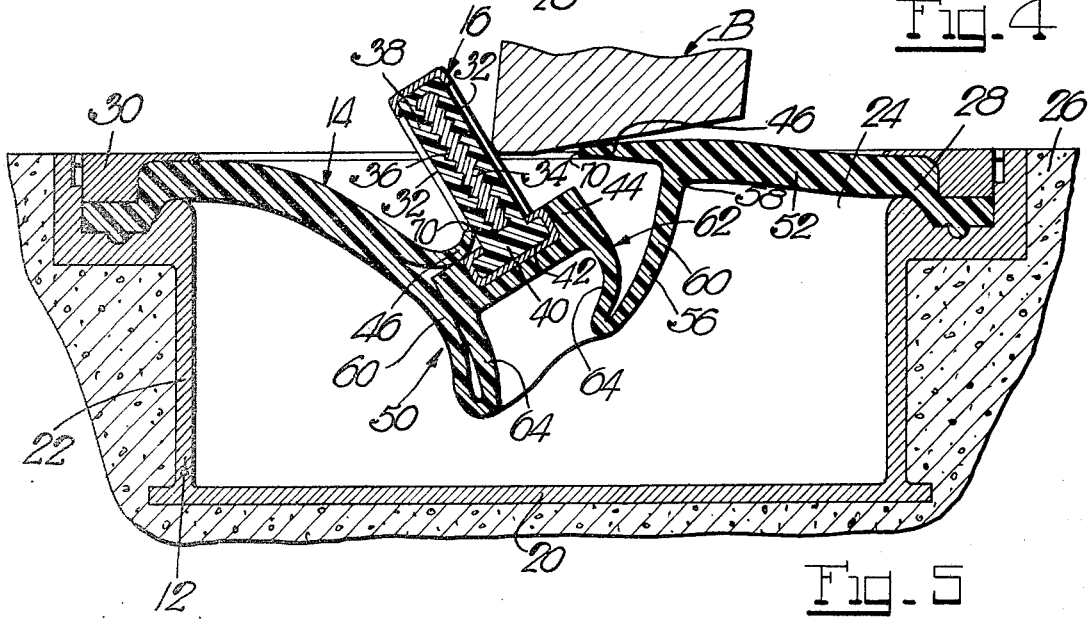

In the accompanying drawings, in which certain modes of carrying out the present invention are shown for illustrative purposes:

FIG. 1 is a fragmentary plan view of a road marker embodying the invention;

FIGS. 2 and 3 are sections through the road marker taken on the lines 2—2 and 3—3, respectively, of FIG. 1; and FIGS. 4 and 5 are sections through the road marker under different operating conditions.

Referring to the drawings, and more particularly to FIGS. 1 to 3 thereof, the reference numeral 10 designates a road marker which has as its major components a casing 12, a diaphragm 14, a light-reflective lens 16 and a lens cleaning device 18.

The casing 12 is in this instance in the form of a cup with a bottom 20, an upright rim 22 and an open top 24, with the marker 10 being installed by being embedded with its casing 12 in a finished road bed 26.

The diaphragm 14 is mounted with a peripheral margin 28 thereof on top of the casing 12 by a retainer ring 30 which is releasably secured to the casing top in any suitable manner, with the diaphragm extending across the open casing top 24 in covering relation therewith. The diaphragm 14 is resilient and is preferably molded of any suitable tough elastomer, such as neoprene, for example.

The lens 16 is rigid and of elongated and substantially flat shape and has opposite reflective faces 32. More particularly, the lens 16 provides in this instance a grid 34 having opposite light-reflective faces 36, and a protective body 38 of any suitable rigid transparent plastic in which the grid 34 is embedded and which provides the lens faces 32 through which light passes to and from the reflective grid faces 36. The lens 16 is also provided on the body 38 thereof with a mounting base 40 which in this instance is fittedly received in a rigid metal channel 42 embedded in a pad formation 44 which may aptly be termed the "lens mount" and which is formed as a part of the diaphragm 14.

The lens cleaning device 18 is formed by two wiper blades 46 which are formed on the diaphragm 14, and a lens suspension system 50 which is also formed by the diaphragm 14.

The lens suspension system 50, which is arranged substantially centrally of and as a continuation of a flat web 52 of the diaphragm, provides an oblong recess 54 which is formed by a depending skirt 56 on and continuous with the diaphragm web 52 as at 58 and provides spaced opposite legs 60, and an oblong channel formation 62 in the recess 54, with this channel 62 having the lens mount 44 as its base, and side legs 64 which at 66 are continuous with the skirt legs 60 and are infolded on the latter (FIGS. 2 and 3). The wiper blades 46 are formed as extensions of the diaphragm web 52 over the recess 54 therein, and they have wiping edges 70 in contact with the opposite lens faces 32, with these wiper blades being substantially coplanar with the web 52 of the diaphragm (FIG. 2).

The diaphragm 14, including all parts of the lens suspension system 50, is molded in the configuration shown in FIG. 2, with the diaphragm being also resilient so that any part thereof will on deformation and subsequent release recover to its normal disposition. Thus, the lens suspension system 50 is shown in FIGS. 2 and 3 in its normal operating disposition in which the lens 16 is in its illustrated rest position at maximum projection above the road bed 26 for optimum reflection of light from an oncoming vehicle back to the driver of the vehicle, with the wiper blades 46 being then in contact with the reflective lens faces 32 at a fairly low level rather close to the lens mount 44 so as to leave most of these reflective lens faces 32 exposed above the road bed 26.

Let it now be assumed that a wheel w of a vehicle is being driven over the installed marker 10 (FIG. 4), the wheel will naturally force the projecting lens 16 out of the way, by depressing the same safely into the interior of the marker casing 12. Such operational depression of the lens 16 is closer to vertical displacement than to a tilting motion under the compelling urge and guidance of the suspension system 50. Thus, the wheel w itself exerts on the projecting lens 16 on its rolling pass thereover a force which is directed primarily downwardly. Moreover, the lens suspension system 50 will respond to this typical depression of the lens 16 by the passing wheel in momentary distortion like or similar to that shown in FIG. 4 which further compels and guides the lens into fairly close vertical downward displacement into the interior of the casing by the passing wheel. With the lens 16 thus yielding to the passing wheel in more or less vertical downward fashion, the blades 46 will already have some wiping action on the light-reflective lens faces 32 and thus start their cleaning. Typical distortion of the suspension system 50 on depression of the lens by the passing wheel (FIG. 4) will also distort the skirt and channel legs 60 and 64 with quite considerable force and thus spring-load the suspension system for powerful and snap-like recovery to its normal operating disposition the moment the passing wheel clears the lens (FIG. 2). Of course, the lens, by participating in such powerful and snap-like recovery of the suspension system, is forced with its light-reflecting faces into rather tight and brushing contact with the wiper blades 64 which is highly conducive to most thorough cleaning of the lens.

Largely contributing to recovery of the lens suspension system from its operational distortion (FIG. 4) by a passing automotive wheel in particularly powerful and snap-like fashion is the arrangement of the skirt and channel legs 60 and 64 in continuity with each other as at 66 and with the channel legs 64 infolded on the skirt legs 60. Thus, in the course of the operational yield of the lens 16 to a passing automotive wheel, the also yielding lens mount 44 will compel the channel legs 64 into particularly severe distortion or flexure as at 64*a* (FIG. 4) which also forces the skirt legs into rather severe distortion or flexure as at 60*a*, with the channel and skirtlegs 64 and 60 being thus flexed in typical S-fashion which is characteristic for particularly powerful recovery of these legs on release from their operational distortion. Further contributing toward the severe distortion of the channel and skirt legs 64 and 60 in the exemplary operational distortion of the lens suspension system (FIG. 4) is the rounded formaion of the joinder 66 between these legs 64 and 60. Also, the lens mount 44 is formed considerably wider than the channel 42 with the fitted lens base 40, so that the paired channel and skirt legs 64 and 60 are of fairly wide spacing (FIG. 2) which contributes toward the desired typical downward depression, rather than undesirable tilting, of the lens under a passing wheel.

The lens suspension system 50, while highly effective in affording particularly good cooperation between the reflective lens and the wiper blades in cleaning the lens on the passage of a wheel over the marker, is also highly effective in giving way to harmless tilting of the lens out of the way of a blade B on a truck (FIG. 5) in the course of plowing the road clear of snow.

What is claimed is:

1. A road marker, comprising a cup-like casing with an open top, a rigid elongated lens with substantially parallel opposite light-reflective faces and a base, and a molded resilient diaphragm peripherally mounted on said casing top and extending thereacross in covering relation therewith, with said diaphragm providing a flat web extending inwardly from the mounted diaphragm periphery, a pair of wiper blades, and a lens suspension system, of which said system comprises a recess in said web formed by a first depending endless oval skirt on and continuous with said web and providing spaced opposite side legs, and an inverted channel in said recess having a base and a therefrom depending second endless skirt, with said skirts having lower ends and being thereat continuous with each other and said second skirt being normally infolded on said first skirt, said lens being mounted with its base on said channel base for normal upright lens disposition, and said wiper blades being continuous with said skirt legs and extending substantially coplanar with said web into contact with said lens faces, with said channel base being at a level at which the mounted lens at rest projects above said casing top and said wiper blades contact said lens faces next to said lens base, whereby on passage of an automotive wheel over said mounted lens the latter is depressed with ensuing resilient distortion of said channel with its skirt turned inside-out and into downward extension on said first skirt, and snap-return of said channel with its base to said level on recovery of said channel from its resilient distortion with ensuing wiping of said lens faces by said wiper blades.

2. A road marker as in claim 1, in which said lower ends of said skirts are formed continuous with each other by a half-round joint.

3. A road marker as in claim 1, in which said second skirt has opposite sides parallel to said side legs of said first skirt, and said opposite skirt sides are spaced apart a distance greater than the projection above said casing top of the mounted lens at rest.

* * * * *